US005623968A

United States Patent [19]

Thorp

[11] Patent Number: 5,623,968

[45] Date of Patent: Apr. 29, 1997

[54] VALVE ASSEMBLY WITH MANUALLY ACTUATED VALVE OVERRIDE

[75] Inventor: Darin J. Thorp, Montpelier, Ohio

[73] Assignee: Ingersoll-Rand Company, Woodcliff Lake, N.J.

[21] Appl. No.: 573,623

[22] Filed: Dec. 18, 1995

[51] Int. Cl.[6] ..... F15B 13/043

[52] U.S. Cl. ..... 137/625.66; 137/625.64; 251/60; 251/285

[58] Field of Search ..... 137/625.64, 625.66; 251/60, 285

[56] References Cited

U.S. PATENT DOCUMENTS

| | | | |
|---|---|---|---|
| 2,580,122 | 12/1951 | Parker . | |
| 2,861,592 | 11/1958 | Collins . | |
| 3,304,953 | 2/1967 | Wickline et al. | 137/625.6 X |
| 3,340,897 | 9/1967 | Nevulis | 137/625.6 |
| 3,416,381 | 12/1968 | Allen . | |
| 3,434,390 | 3/1969 | Weiss | 137/625.64 X |
| 3,477,344 | 11/1969 | Fisher | 137/625.64 |
| 3,534,770 | 10/1970 | Kowalski | 137/509 |
| 4,076,210 | 2/1978 | Spielvogel | 251/285 |
| 4,207,917 | 6/1980 | Opel et al. | 137/269 |
| 4,544,128 | 10/1985 | Kolchinsky et al. | 251/30.01 |
| 4,574,843 | 3/1986 | Loup et al. | 137/625.65 |
| 5,074,326 | 12/1991 | Baker et al. | 137/15 |
| 5,092,365 | 3/1992 | Neff | 137/625.65 |
| 5,197,507 | 3/1993 | Miki et al. | 137/1 |
| 5,218,999 | 6/1993 | Tanimoto | 137/625.65 |
| 5,404,912 | 4/1995 | Hausler et al. | 137/625.64 |

FOREIGN PATENT DOCUMENTS

| | | | |
|---|---|---|---|
| 442915 | 1/1968 | Switzerland | 137/625.66 |

*Primary Examiner*—Gerald A. Michalsky
*Attorney, Agent, or Firm*—Michael M. Gnibus

[57] ABSTRACT

A valve assembly for a pneumatic machine including a valve body having a first end, a second end, a central bore extending through the ends and a plurality of flow ports formed in the body; a valve spool movable through the bore along an axis in response to the flow of gas through the valve, to selectively open and seal the ports; an main inlet valve for moving the valve spool a distance along the axis; and a manually actuated means for overriding the main inlet valve.

10 Claims, 2 Drawing Sheets

VALVE ASSEMBLY WITH MANUALLY ACTUATED VALVE OVERRIDE

BACKGROUND OF THE INVENTION

This invention generally relates to a valve assembly for a pneumatic machine, and more particularly to an improved valve assembly for a pneumatic machine which includes a manually actuated means for overriding actuation of the valve.

Pneumatic machines use a gas typically air to displace at least one piston and thereby actuate the machine. Such machines include a valve assembly which controls the volume of gas that is supplied to displace each of the at least one pistons. The valves are opened by conventional mechanical or electrical means.

The mechanical or electrical means moves a spool or like member rapidly in a first direction, to open the valve and permit gas to flow to the piston. Once the valve is opened, the position of the spool or like member can only be altered by again actuating the mechanical or electrical means. Thus the flow volume of gas through the valve can not be easily adjusted or precisely adjusted. For example, the valve can be shifted in a first direction so that gas flows from the valve inlet to a first cylinder inlet. However, if it is necessary to alter the volume of gas flowing through the first cylinder inlet or redirect the gas flow to a second cylinder inlet, the electrical/mechanical means must be actuated. The valve can not be shifted to change flow to inlet to a second cylinder valve without energizing the mechanical or electrical means. Moreover, precise adjustments to the flow volume through a cylinder inlet are difficult.

Additionally, before using a pneumatic machine, it is typically necessary to test the alignment of the operative machine member that is displaced by the piston. If the operative member is misaligned, the machine will likely be damaged during operation. For example, in pneumatic printing machines, the piston is operatively connected to one or more print heads to move the printheads as the piston is displaced. Before operating such a printing machine it is necessary to check the alignment of the printheads. It is most desirable to check the alignment by slowly actuating the piston by finely adjusting and slowly increasing the gas supplied to the cylinder rather than by rapidly actuating and opening the valve. If the printhead is not in proper alignment, and the valve is opened rapidly using a conventional valve, the printheads can crash and damage the machine. By opening the valve slowly alignment can be carefully checked without incurring machine damage. Known valves for pneumatic machines make preliminary testing and checking of pneumatic machines difficult since the valve can not be adjusted without energizing the electrical/mechanical means and because making fine adjustments to the valve position is difficult.

The foregoing illustrates limitations known to exist in present devices and methods. Thus, it is apparent that it would be advantageous to provide an alternative which permits the mechanical or electrical actuating means to be overridden to control the supply of gas to the cylinder. Accordingly, a suitable alternative is provided including features more fully disclosed hereinafter.

SUMMARY OF THE INVENTION

In one aspect of the present invention, this is accomplished by providing a pneumatic valve override assembly including a valve assembly for controlling the flow of gas to a pneumatic machine, the valve assembly comprising: a valve body having a first end, a second end, a bore extending through the ends and a plurality of flow ports formed therein; a valve spool movable through the bore along an axis in response to the flow of gas through the valve, to selectively open and seal the ports; means for moving the valve spool a distance along the axis towards one end of the body; and manually actuated means for overriding the means for moving the valve spool towards one body end.

The foregoing and other aspects will become apparent from the following detailed description of the invention when considered in conjunction with the accompanying drawing figures.

BRIEF DESCRIPTION OF THE DRAWING FIGURES

FIG. 1 is a partial longitudinal sectional view of the valve assembly of the present invention; and FIG. 2 is an enlarged sectional view of a portion of the sectional view of FIG. 1.

DETAILED DESCRIPTION OF THE PREFERRED EMBODIMENT

Figure 1:
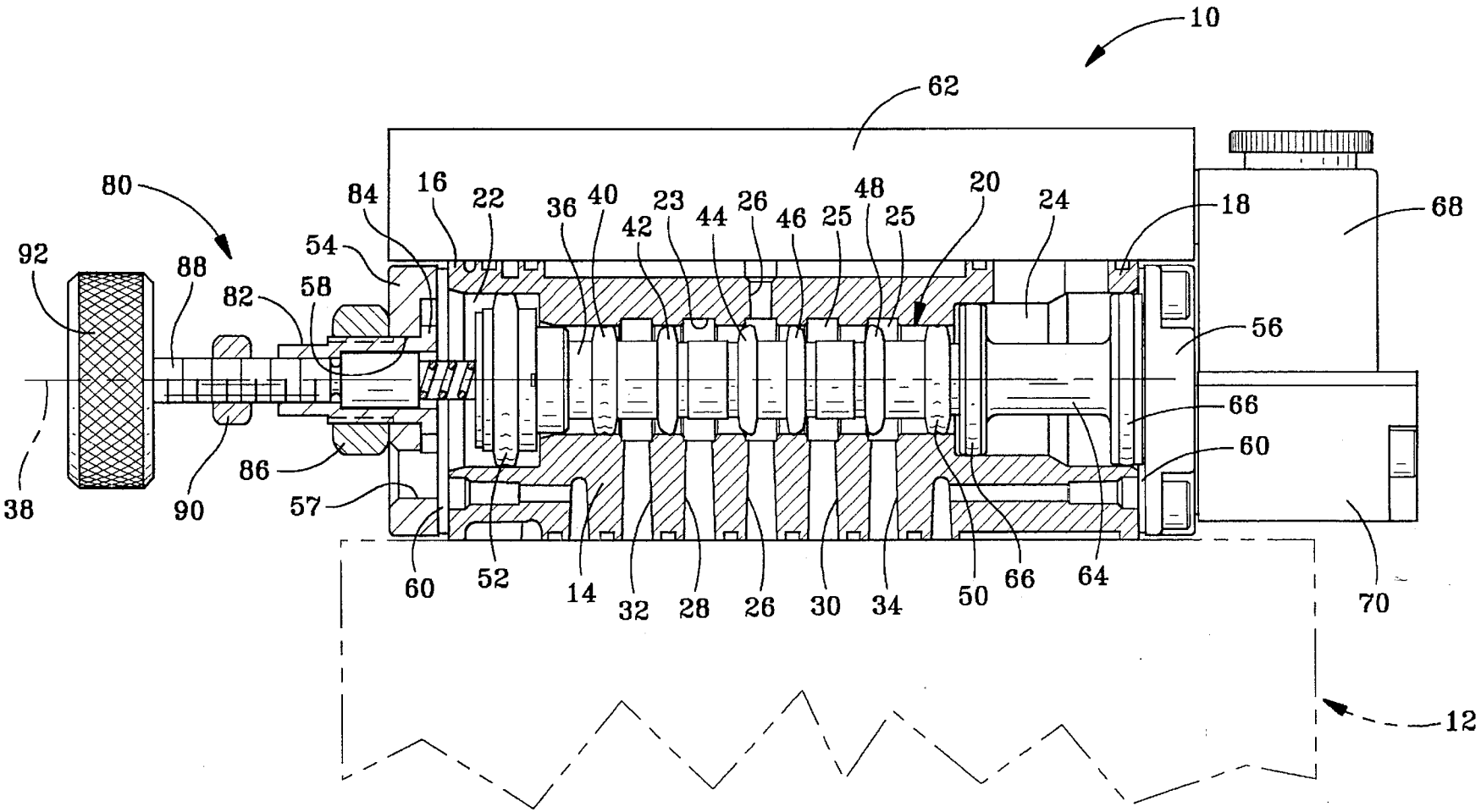

Referring now to the drawings, wherein similar reference characters designate corresponding parts throughout the several views, FIG. 1 shows a valve assembly generally indicated at 10 which is flow connected to a pneumatic machine shown schematically in phantom lines at 12. Gas supplied to the machine, typically air, flows through the valve to at least one piston cylinder of the machine. The valve limits the volume of gas supplied to the machine and also directs the supplied volume of gas to the at least one cylinder.

Valve assembly 10 includes a valve body 14 having a first end 16, a second end 18 and a longitudinally extending central bore 20 which extends through the ends 16 and 18 of the valve body. The central bore has relatively wide end portions 22 and 24 at the first and second ends respectively of the valve body 14. The wide portions are joined by a central bore middle portion 23. As shown in FIG. 1, a number of discrete annular flow passages 25 are formed in the wall of the middle portion of the central bore. The flow passages have a larger radial dimension than the middle portion of the central bore and extend into the wall of bore 20 with each pair of adjacent discrete flow passages separated by a wall segment of the central bore. In this way, a configuration of alternating "shoulders and recesses" is formed in the middle portion of the central bore. See FIG. 1.

A plurality of laterally extending ports are provided in the valve body including inlet port 26, cylinder ports 28 and 30, and exhaust ports 32 and 34. Each of the ports is in fluid flowing communication with a respective flow passage 25. Gas which enters the valve body through the inlet 26, flows to the machine 12 through the cylinder ports 28 and 30 in a manner well known in the art. Conversely, gas is exhausted from the machine cylinder through the valve body exhaust ports 32 and 34. Although the valve body is disclosed as having five discrete ports, it should be understood that any suitable number of ports may be provided in the valve body.

Spool 36 is adapted to move linearly along axis 38 through central bore 20. Lobes 40, 42, 44, 46, 48 and 50 are made integral with the spool along the length of the spool and are located in predetermined positions along the spool length in order to sealingly engage a respective wall section along the middle portion 23 of central bore 20 during operation of valve assembly 10. Each lobe extends around the spool 36.

During operation of valve 10, lobe 40 is in continuous sealing engagement with the wall section of the middle portion of bore 20 between wide end portion 22 and exhaust port 32, and lobe 50 is in continuous sealing engagement with the wall section of central bore 20 between wide end portion 24 and exhaust port 34. In this way, gas is prevented from leaking out of the valve body.

Lobes 42–48 may be moved into and out of sealing engagement with a respective wall section of the central bore to seal and open an associated port to the flow of gas. More specifically, lobe 42 is moved into and out of sealing engagement with the wall section of central bore 20 separating ports 32 and 28 to control gas flow through exhaust port 32. Lobe 44 is moved into and out of sealing engagement with the wall section of central bore 20 separating ports 28 and 26 to control gas flow through cylinder port 28. Lobe 46 is moved into and out of sealing engagement with the wall section of central bore 20 separating ports 26 and 30 to control gas flow through cylinder port 30. Lobe 48 is moved into and out of sealing engagement with the wall section of central bore 20 separating ports 30 and 34 to control the flow of gas through exhaust port 34. The lobes 42–48 engage the respective wall section separating the adjacent ports to seal the associated port from the flow of gas. When the lobes are not in sealing engagement with the central bore, the lobe is located substantially in the flow passage 25 that is in fluid flowing communication with the associated port.

Spool 36 also includes lobe 52, like lobes 40–50, and is made integral with the spool end located in central bore wide end portion 22. The lobe 52 sealingly engages the wall of the bore wide portion.

A first endcap 54 substantially closes the first end 16 of the valve body and second endcap 56 substantially closes the second end of the valve body. Each endcap includes an opening 58 and is removably attached to the respective end of the valve body by conventional fasteners such as bolts or the like. The first endcap includes a breather port 57 which permits gas that may be trapped in the valve to be released to prevent the formation of a vacuum in the valve. A conventional gasket 60 is sandwiched between each respective endcap and the associated end of the valve body.

Valve coverplate 62 overlays the top of the valve body 14 in the manner shown in FIG. 1.

A transition spool 64 is located in central bore wide end portion 24 between the spool end and endcap 56, and is movable linearly within the wide portion along axis 38. The transition spool includes a pair of disk-shaped contact members 66 made integral with the spool at the spool ends. The end 66 of spool 64 nearest the spool 36 is adapted to abut the end of spool 36 to force the spool 36 away from end 18.

Conventional solenoid 68 is actuated by a conventional operator 70. Both the operator 70 and solenoid 68 are well known to one skilled in the art. The operator 70 is energized to open and close the solenoid as required to permit or restrict gas flow into the valve body through the opening (not shown) in the endcap 56.

Figure 2:
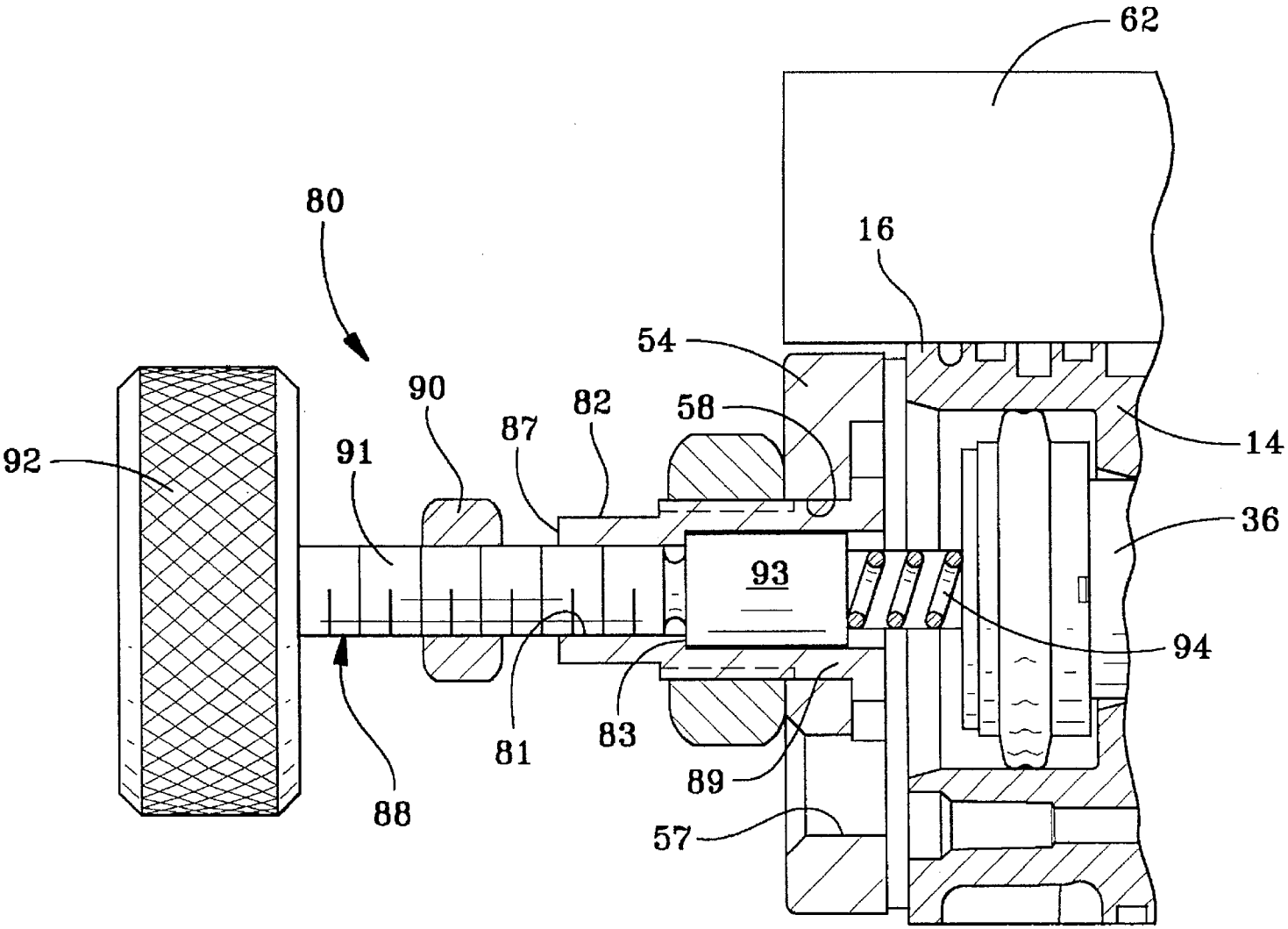

Valve assembly 10 also includes manually actuated valve override indicated generally at 80. Turning now to FIG. 2 which is an enlarged view of the override 80, the override includes a housing 82 having a partially threaded exterior, a first housing end 87, a second housing end 89, and a bore 81 that extends through the housing ends. The bore 81 includes a threaded portion at the first housing end and also includes a shoulder 83 which is located between the threaded and non-threaded portions of the bore 81.

An annular flange 84 is made integral with the housing at the second housing end and is adapted to abut the interior of the endcap 54 in the manner shown in FIG. 2 when the housing is inserted through the opening 58 in the endcap 54.

A locking nut 86 is adapted to be threadably connected to the threaded portion of the housing exterior and maintains the housing in the desired location during operation of the valve.

A needle 88 extends through the housing bore 81 along axis 38 as shown in FIG. 2. The needle includes a first needle portion 91 and a second needle portion 93. The second needle portion has a greater lateral dimension than the first needle portion and is adapted to engage shoulder 83 along the outer periphery of the relatively wide portion 93. The first needle portion has a threaded exterior and has a free end that extends outward from the first housing end 87. The first needle portion threadably engages the threaded portion of bore 81.

A knob is connected to the free end of the first needle portion 91. A conventional knurl is provided along the gripping surface of the knob and serves to assist an operator grip and turn the knob. A lock nut 90, is located along the threaded portion of the needle portion 91 and limits movement of the needle toward valve body end 16.

A conventional coil spring 94 is sandwiched between the end of the second needle portion 93 and the end of the spool 36 located in wide portion 22. The spring biases the spool towards the valve body end 18 and in this way overrides the movement of the valve spool by the solenoid and operator.

Operation of the valve will now be described. Initially, the operator is energized and the solenoid is actuated, permitting gas to enter the valve body, through the endcap 56. The gas flows against end 66 near endcap 56 and urges the transition spool along axis 38 and away from endcap 56. The transition spool abuts spool 36 and thereby urges the spool 36 along axis 38, away from end 18. The spool 36 is displaced towards end 16 until the spring 94 is fully compressed. Ports 26 and 30 are opened so that the gas flows from 26 to 30 and into the machine cylinder. It is believed that the spring acts as an impact absorbing member, to cushion the needle from the impact of the rapid movement of the spool 36.

In order to shift the position of spool 36 and thereby override the movement of valve spool 36 by the solenoid, the needle is moved linearly along axis 38 towards valve body 14. A machine operator turns knob 92 in a first direction, preferably clockwise, in order to move the needle inward. Movement of the needle into the housing 82 urges the spool 36 towards end 18. As the needle is moved inward, the initial displacement of the spool by the solenoid is overridden and the volume and direction of flow is manually controlled. Continued inward movement of the needle will move the lobes into sealing engagement with the center bore 20 as described hereinabove. Further movement of the needle inward will open cylinder port 28 and redirect gas flow to the machine so that the gas flows from port 26 to port 28. This is shown in FIG. 1. The needle can be backed out from the housing by turning the knob in a second direction, preferably counter clockwise. Movement of the needle out of the housing is limited by engagement between the shoulder 83 and the outer periphery of the second needle portion.

Before actuating the valve, the needle may be rotated inward so that the initial displacement of the spool is limited by the needle. By limiting the initial displacement of the spool 36, the associated cylinder port will not be fully opened and the volume of air supplied to the machine will be limited.

In this way, a machine may be "feathered" or eased into operation. The operation of the machine piston can be controlled by manually overriding actuation of the spool 36 by the operator using override 80. Rather than maximizing flow to the machine upon startup, the gas flow to the machine can be controlled and redirected, thereby permitting controlled machine component alignment checking and preventing damage to the machine.

While I have illustrated and described a preferred embodiment of my invention, it is understood that this is capable of modification, and I therefore do not wish to be limited to the precise details set forth, but desire to avail myself of such changes and alterations as fall within the purview of the following claims.

Having described the invention, what is claimed is:

1. A valve assembly for controlling the flow of gas to a pneumatic machine, the valve assembly comprising:

a) a valve body having a first end, a second end, a bore extending through the ends and a plurality of flow ports formed therein, said plurality of flow ports including at least one fluid inlet port;

b) a valve spool having a first valve spool end and a second valve spool end, said valve spool being movable through the bore along an axis to control the flow of gas through the valve, to selectively open and seal the ports;

c) means for moving the valve spool in a first direction a distance along the axis towards the first end of the valve body, said means for moving the valve spool being movable in response to the flow of gas through the at least one inlet port, said means also including a first contact portion adapted to engage the second valve spool end to move the valve spool the required distance along the axis; and d) manually actuated means for overriding the means for moving the valve spool towards the first end of the valve body, said manually actuated means including a contact member having a contact end adapted to engage the first valve spool end when the valve spool has moved the required distance along the axis, wherein said contact member biases the valve spool member in a second direction upon engagement with the first valve spool member end.

2. The valve assembly as claimed in claim 1 wherein the valve assembly includes a first endcap substantially closing the first end, a second endcap substantially closing the second end of the valve body, each endcap having an opening, wherein the manually actuated means for overriding the means for moving the valve spool towards the first valve body end comprises a housing located in the opening provided in the first endcap, the housing having a first housing end, a second housing end and a bore extending through the housing ends; a needle having a first end and a second end, said needle extending into the housing bore and movable through the bore along the axis; the contact member is adapted to be sandwiched between the second end of the needle and the first end of the spool when the spool engages the contact member, and means for moving the needle along the axis.

3. The valve assembly as claimed in claim 2 wherein the means for moving the needle along the axis is a knob connected to the first end of the needle.

4. The valve assembly as claimed in claim 2 wherein the contact member is a coil spring.

5. The valve assembly as claimed in claim 2 wherein the housing has an exterior that includes a threaded portion and a locking nut located along the threaded portion of the housing.

6. The valve assembly as claimed in claim 5 wherein the housing bore includes a threaded portion and wherein the needle includes a threaded first needle portion, a second needle portion, the first needle being threadably connected to the threaded portion of the bore.

7. The valve as claimed in claim 6 wherein a second locking nut is threadably connected to the first needle portion.

8. A valve assembly for controlling the flow of gas to a pneumatic machine, the valve assembly comprising:

a) a valve body having a first end, a second end, a bore extending through the ends, a plurality of flow ports formed therein, said plurality of flow ports including at least one fluid inlet port, said valve body also including an endcap for substantially closing the first end of the valve body, the endcap having an opening;

b) a valve spool movable through the bore along an axis to control the flow of gas through the valve, to selectively open and seal the ports, the spool having first and second valve spool ends;

c) means for moving the valve spool in a first direction a distance along the axis towards the first end of the valve body, said means for moving the valve spool being movable in response to the flow of gas through the at least one inlet port, said means also including a first contact portion adapted to engage the second valve spool end to move the spool the required distance along the axis; and d) manually actuated means for overriding the means for moving the valve spool towards the first end of the valve body, wherein the manually actuated means for overriding the means for moving the valve spool towards the first end of the valve body comprises a housing located in the opening provided in the first endcap, the housing having a first housing end, a second housing end and a bore extending through the housing ends; a needle having a first end and a second end, said needle extending into the housing bore and movable through the bore along the axis; a contact member adjacent the second needle end the contact member having a contact end adapted to engage the first valve spool end when the valve spool has moved the required distance along the axis and a second contact member end adapted to engage the second needle end, wherein said contact member biases the valve spool member in a second direction upon engagement with the first valve spool member end, and wherein the contact member is adapted to be sandwiched between the second end of the needle and the first end of the valve spool, and means for moving the needle along the axis.

9. The valve assembly as claimed in claim 8 wherein the housing includes a flange at the second housing end, the flange being adapted to abut the endcap.

10. The valve assembly as claimed in claim 9 wherein the housing includes a shoulder formed along the length of the bore, the needle including a portion adapted to engage the shoulder to thereby limit movement of the needle.

* * * * *

UNITED STATES PATENT AND TRADEMARK OFFICE

CERTIFICATE OF CORRECTION

PATENT NO. : 5,623,968

DATED : April 29, 1997

INVENTOR(S) : Thorp

It is certified that error appears in the above—identified patent and that said Letters Patent is hereby corrected as shown below:

On the title page, item [75], delete "Darin J. Thorp" and replace with -- Darin L. Thorp -- .

Signed and Sealed this

Twenty-second Day of July, 1997

Bruce Lehman

*Attest:*

BRUCE LEHMAN

*Attesting Officer*

*Commissioner of Patents and Trademarks*